US007676981B2

(12) United States Patent
Buckingham et al.

(10) Patent No.: US 7,676,981 B2
(45) Date of Patent: Mar. 16, 2010

(54) PHOTOLUMINESCENT (PL) WEAPON SIGHT ILLUMINATOR

(75) Inventors: Thomas Martin Buckingham, Severna Park, MD (US); Herbert Jones, Elkton, MD (US)

(73) Assignee: Defense Holdings, Inc., Manassas, VA (US)

( * ) Notice: Subject to any disclaimer, the term of this patent is extended or adjusted under 35 U.S.C. 154(b) by 99 days.

(21) Appl. No.: 11/440,097

(22) Filed: May 25, 2006

(65) Prior Publication Data

US 2008/0295380 A1 Dec. 4, 2008

Related U.S. Application Data

(60) Provisional application No. 60/684,990, filed on May 27, 2005.

(51) Int. Cl.
*F41G 1/00* (2006.01)

(52) U.S. Cl. ..... 42/132; 42/123; 42/130; 42/131

(58) Field of Classification Search ..... 42/113, 42/122, 123, 130, 131, 132, 144, 145; 359/424, 359/399, 428
See application file for complete search history.

(56) References Cited

U.S. PATENT DOCUMENTS

| | | | | |
|---|---|---|---|---|
| 1,292,211 | A | | 1/1919 | Young et al. |
| 1,307,063 | A | | 6/1919 | Palmer |
| 2,373,984 | A | | 4/1945 | Trask |
| 2,395,185 | A | | 2/1946 | Sampson |
| 2,423,141 | A | | 7/1947 | Ferrel |
| 2,706,335 | A | | 4/1955 | Munsey |
| 2,891,326 | A | | 6/1959 | Fransson |
| 2,987,821 | A | | 6/1961 | Kettler |
| 3,500,545 | A | | 3/1970 | Chivers |
| 3,641,676 | A | | 2/1972 | Knutsen et al. |
| 3,698,092 | A | | 10/1972 | Rosenhan |
| 3,769,884 | A | * | 11/1973 | Sigman ..... 396/549 |
| 3,820,248 | A | | 6/1974 | Hayward |
| 3,916,530 | A | | 11/1975 | Tellie |
| 4,070,763 | A | * | 1/1978 | Carts, Jr. ..... 42/132 |
| 4,806,007 | A | | 2/1989 | Bindon |
| 4,877,324 | A | * | 10/1989 | Hauri et al. ..... 356/251 |
| RE33,485 | E | | 12/1990 | Frimer |
| 4,998,391 | A | | 3/1991 | Connew |
| 5,140,151 | A | * | 8/1992 | Weiner et al. ..... 359/210 |
| 5,560,712 | A | * | 10/1996 | Kleinerman ..... 374/161 |
| 5,607,621 | A | | 3/1997 | Ishihara |
| 5,653,034 | A | * | 8/1997 | Bindon ..... 42/131 |
| 5,853,614 | A | | 12/1998 | Hao et al. |
| 5,862,618 | A | * | 1/1999 | Brown ..... 42/145 |
| 5,926,963 | A | * | 7/1999 | Knight ..... 42/132 |
| 5,992,030 | A | | 11/1999 | Mann |
| 6,014,830 | A | * | 1/2000 | Brown et al. ..... 42/145 |
| 6,058,616 | A | | 5/2000 | Bubits |

(Continued)

*Primary Examiner*—Stephen M Johnson
*Assistant Examiner*—Daniel J Troy
(74) *Attorney, Agent, or Firm*—Oblon, Spivak, McClelland, Maier & Neustadt, L.L.P.

(57) ABSTRACT

Methods and systems are described herein for an article of manufacture for use in a weapon sight wherein the article of manufacture comprises a passively charged photoluminescent material. When installed in a weapon sight, the passively charged photoluminescent material provides light to a fiber optic of the weapon sight during low light conditions to illuminate a reticle pattern of the weapon sight.

13 Claims, 6 Drawing Sheets

U.S. PATENT DOCUMENTS 6,122,833 A * 9/2000 Lorocco ..... 42/132
6,307,207 B1 10/2001 Burbank
6,359,381 B1 * 3/2002 Okuno et al. ..... 313/485
6,360,471 B1 3/2002 Stein
6,360,472 B1 * 3/2002 Lorocco ..... 42/132
6,571,482 B1 * 6/2003 Tymianski ..... 33/265
6,571,504 B2 * 6/2003 Carlson ..... 42/132
6,604,315 B1 * 8/2003 Smith et al. ..... 42/112
6,696,126 B1 2/2004 Fischer et al.
6,928,213 B2 * 8/2005 Neuberger ..... 385/31
7,234,265 B1 * 6/2007 Cheng et al. ..... 42/113
2002/0015433 A1 * 2/2002 Zimmermann ..... 372/96
2003/0086165 A1 * 5/2003 Cross et al. ..... 359/424
2004/0011997 A1 1/2004 Rogers et al.
2004/0135122 A1 7/2004 Hyland et al.
2004/0200118 A1 * 10/2004 Chen ..... 42/132
2005/0048263 A1 3/2005 Ford et al.
2005/0052880 A1 3/2005 Buckingham et al.
2006/0035079 A1 * 2/2006 Xu et al. ..... 428/402
2006/0046093 A1 * 3/2006 Landry et al. ..... 428/690
2006/0092507 A1 * 5/2006 Menges et al. ..... 359/428
2006/0288627 A1 * 12/2006 Liang ..... 42/123

* cited by examiner

PHOTOLUMINESCENT (PL) WEAPON SIGHT ILLUMINATOR

CROSS-REFERENCE TO RELATED APPLICATIONS

This application claims the benefit of U.S. Provisional Application No. 60/684,990 filed May 27, 2005, which is incorporated herein by reference.

BACKGROUND

1. Field of the Invention

The present invention relates generally to weapon sights, and more particularly, to illuminators in weapon sights.

2. Related Art

The soldier has long required an effective, reliable, non-electric low-light illuminator in weapon sights for night-time target acquisition and as a backlight in selected instrument gages, dials and similar devices. For years, the only available light source that satisfied most of these requirements was tritium.

Tritium is a radioactive isotope of the element hydrogen. The radioactive properties of tritium have proved very useful. By mixing tritium with a phosphor that emits light in the presence of radiation in a sealed glass vial, a continuous light source may be formed. Such a light source may be used in situations where a dim light is needed but where using batteries or electricity is not possible. Weapon sights, instrument dials and EXIT signs are several of the most common military/commercial applications of where such a light source is currently used. Tritium weapon sights, for example, help increase night time firing accuracy and the Tritium EXIT signs provide continuous illumination when there is a loss of power.

The use of Tritium, however, carries some serious drawbacks. For example, the use of tritium introduces significant safety risks, hazardous waste concerns and measurable legacy costs. Additionally, if the sealed vials containing the radioactive material is damaged, not only is the light source inactivated, but there may be a low level release of radioactivity that must be addressed. Other drawbacks of tritium include the following: 1) depending upon the amount used, tritium is subject to regulation by the Nuclear Regulatory Commission and improper handling and control of tritium can lead to fines and punitive actions; 2) depending upon the amount used, disposal of tritium-containing materials must be handled as radioactive waste, resulting in significant cost and management oversight of such materials; 3) breakage of tritium vials currently must be treated as a Hazardous Material spill; 4) tritium is a radioactive beta particle emitter and thus, if ingested into the digestive tract, inhaled into the lungs or absorbed into the blood stream through an open wound, tritium poses a known health risk; and 5) the half-life of Tritium is about 14 years, with decay beginning the day the device incorporating the tritium is made. Thus, tritium light sources typically have an effective life of 5-7 years, at which point they become too dim and must be replaced. In sum, radioactive tritium in weapons sights may present a potential health hazard, logistic difficulties and significant life cycle handling and disposal costs.

As such there is a need for improved methods and systems for low-light illumination within weapon sights.

SUMMARY

According to a first broad aspect of the present invention, there is provided an article of manufacture for use in a weapon sight. The article of manufacture comprises a passively charged photoluminescent material; and wherein the article of manufacture is configured so that when installed in the weapon sight, the passively charged photoluminescent material provides light to a fiber optic of the weapon sight during low light conditions to illuminate a reticle pattern of the weapon sight.

According to another aspect, there is provided a weapon sight including a first set of one or more optical lenses located at a forward end of the weapon sight for receiving light from a target to be sighted, a second set of one or more optical lenses located at a rearward end of the weapon sight for viewing an image of the target. The weapon sight also includes an image erector mechanism located with the weapon sight and between the first and second set of one or more optical lenses for providing a properly oriented image of the target through the second set of one or more optical lenses and a reticle projecting mechanism for providing a reticle pattern with the image of the target from the second set of one or more optical lenses. The weapon sight further includes a fiber optic at least partially external to the weapon sight and configured to collect and transmit light to the reticle projecting mechanism so as to illuminate the reticle pattern. Additionally, the weapon sight includes a photoluminescent shield at least partially external to the weapon sight and covering at least a portion of the fiber optic, wherein the photoluminescent shield comprises a passively charged photoluminescent material, and wherein the photoluminescent shield is configured to provide light to the fiber optic during low light conditions to illuminate the reticle pattern.

In yet another aspect, there is provided a weapon sight including a first set of one or more optical lenses located at a forward end of the weapon sight for receiving light from a target to be sighted, and a second set of one or more optical lenses located at a rearward end of the weapon sight for viewing an image of the target. The weapon sight further includes an image erector mechanism located with the weapon sight and between the first and second set of one or more optical lenses for providing a properly oriented image of the target through the second set of one or more optical lenses, and a reticle projecting mechanism for providing a reticle pattern with the image of the target from the second set of one or more optical lenses. Additionally, the weapon sight includes a fiber optic at least partially external to the weapon sight and configured to collect and transmit light to the reticle projecting mechanism so as to illuminate the reticle pattern. The weapon sight also includes a photoluminescent tube at least partially internal to the weapon sight and covering at least a portion of the fiber optic, wherein the photoluminescent tube comprises a passively charged photoluminescent material, and wherein the photoluminescent tube is configured to provide light to the fiber optic during low light conditions to illuminate the reticle pattern.

BRIEF DESCRIPTION OF THE DRAWINGS

The invention will be described in conjunction with the accompanying drawings, in which.

DETAILED DESCRIPTION

Figure 1:
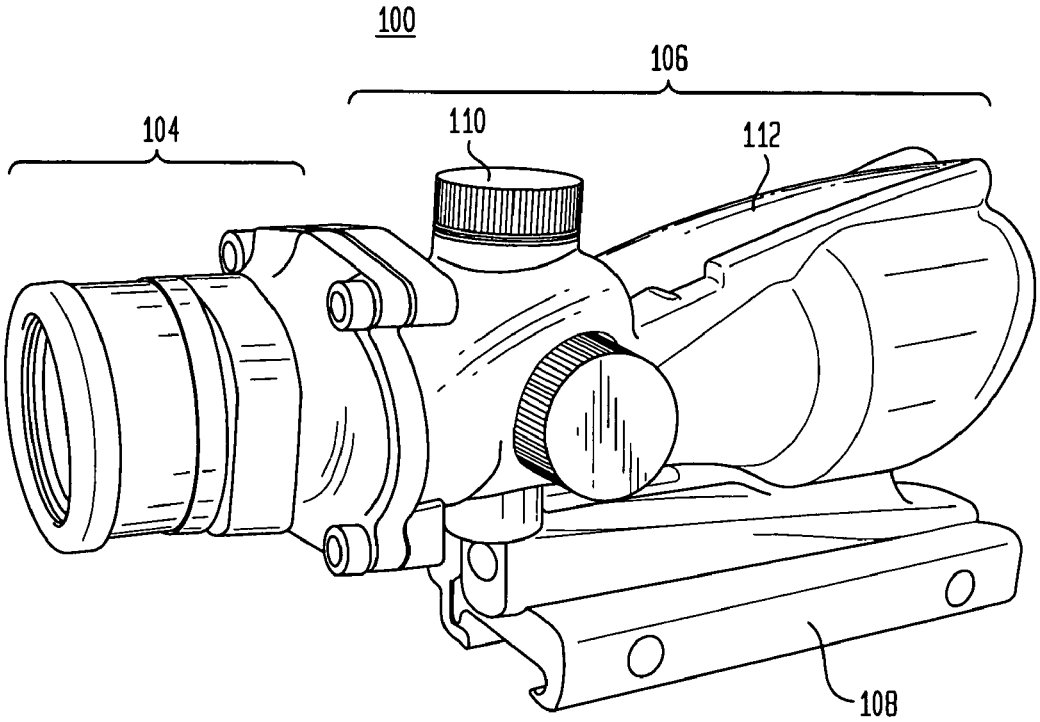
FIG. 1 illustrates a weapon sight, in accordance with an aspect of the invention.

It is advantageous to define several terms before describing the invention. It should be appreciated that the following definitions are used throughout this application.

DEFINITIONS

Where the definition of terms departs from the commonly used meaning of the term, applicant intends to utilize the definitions provided below, unless specifically indicated.

For the purposes of the present invention, the term "weapon sight" refers to any device for assisting the aim of a weapon, such as a firearm. Exemplary firearms include handguns, M16 rifles, machine guns, M203 grenade launchers, mortars, bazookas, tasers, etc.

For the purpose of the present invention, the term "optical lens" refers to any device capable of being used for focusing light. Exemplary optical lenses may be manufactured from glass, plastic, or any other acceptable material.

For the purpose of the present invention, the term "image erector mechanism" refers to any item capable of being used for modifying the orientation of an image, such as for example, a mechanism capable of inverting an image. Exemplary image erector mechanisms include, for example, the Schmidt-Pechan prism.

For the purpose of the present invention, the term "reticle" refers to a grid or pattern used in an optical instrument, such as a weapon sight, to establish a scale or a position.

For the purpose of the present invention, the term "reticle projecting mechanism" refers to any item capable of being used for making a reticle visible. Exemplary reticle projecting mechanisms include, for example, a silver or reflective coat onto which a reticle pattern is drawn or etched.

For the purpose of the present invention, the term "rod" refers to an elongated transitional connection between fiber optic components.

For the purpose of the present invention, the term "fiber optic" refers to a fiber (e.g., a threadlike object of structure) capable of permitting light transmission through the fiber. Exemplary fiber optics include, for example, flexible fibers manufactured from glass, plastic, or any other suitable material. In some embodiments of the present invention, fiber optics comprise fibers capable of receiving light and permitting the transmission of the received light in a direction perpendicular to the length of the fiber. Further, as used herein a fiber optic may comprise multiple fiber optics interconnected by, for example, a rod.

For the purpose of the present invention, the term "shield" refers to an item configured or capable of covering another device or material. Examples of shields include, for example, an item, such as a photoluminescent and/or translucent item, configured to cover a fiber optic included in a weapon sight.

For the purpose of the present invention, the term "tube" refers to a hollow cylindrically shaped item. In some embodiments, a tube may comprise one or more layers comprised of different materials or substances.

For the purpose of the present invention, the term "passively charged" refers to the activation of non-radioactive photoluminescent materials by exposure to natural or artificial light sources. The photoluminescent material absorbs energy from the light source during the process of being passively charged. An example of passively charging a photoluminescent material using natural or artificial light is described below.

For the purposes of the present invention, the term "photoluminescent material" refers to any item exhibiting photoluminescent characteristics. Examples of photoluminescent materials include paint, film, and powder coatings comprising strontium aluminate (SrAl) or similar high performance phosphor particles.

For the purposes of the present invention, the term "extinction time" refers to the time required for the afterglow of a light source to diminish to where it is no longer perceptible to a human (e.g., the average person). For example, the extinction time may be the time it takes for the afterglow to diminish to 0.032 mcd/$m^2$, which is generally considered to be the limit of human perception.

For the purposes of the present invention, the term "photoluminescent characteristics" refers to an items ability to absorb light and later emit light, such as for example, during low light or darkened conditions.

Description

Embodiments of the preset invention are directed to a Photoluminescent Weapon Sight Illuminator (PWSI) in or on a weapon sight for targeting in low light or dark conditions. This PWSI may comprise a photoluminescent material and, for example, be used in place of (or to replace) tritium lamps used in current weapon sights. Advantages of exemplary PWSIs include that the PWSI's photoluminescent material may be located on a weapon sight such that the photoluminescent material may remain visible in all weather and lighting conditions and that it may be useable even in a damaged condition. Prior to describing exemplary embodiments in which a PWSI is included in or on a weapon sight, an overview of photoluminescence will first be presented.

The basic principle behind photoluminescence is straightforward: electrons orbiting atoms or molecules of the phosphor absorb energy through collision with photons during excitation. The excitation source may be electromagnetic radiation (e.g., visible and invisible light). After the photoluminescent material has been exposed to the excitation source for a sufficient period of time, the photoluminescent material may reach a steady state with the excitation energy source where the photoluminescent material is considered fully "charged" or "activated."

When the excitation source is extinguished (e.g., removed or turned off), the electrons that were trapped in lower energy excited states slowly return to their original state and phosphorescent materials release the stored energy in the form of visible light. It is this light, called "afterglow," which may be perceived as a glow-in-the dark light source. The intensity of the afterglow (referred to as luminance performance) is typically measured in units of milli-candellas per $m^2$ of photoluminescent material. The luminance performance and the time to fully charge a particular photoluminescent material may vary depending on the characteristics of the photoluminescent material (e.g., the phosphor). Further, this afterglow decreases over time, exhibiting a hyperbolic decay.

The equation describing the decay is:

$$L_t = L_0 \frac{b^\alpha}{(b+t)^\alpha}$$

where t is time in seconds; $L_0$ is the initial luminance as measured in milli-candellas per square meter (mcd/m$^2$); $L_t$ is the luminance at time t; and $\alpha$ and b are constants that depend on the chemical composition and physical properties of the photoluminescent material. In assessing the real world utility of a photoluminescent material, one characteristic used to quantify its brightness and longevity is extinction time. The extinction time is generally defined as the time required for the afterglow to diminish to 0.032 mcd/m$^2$, the limit of human perception.

In addition to the particular phosphor used in the photoluminescent material, the luminance performance may also be dependent on other characteristics of the photoluminescent material. For example, in embodiments, as will be discussed in more detail below, rare earth elements may be included in the photoluminescent material to improve its performance. Further, the phosphor density in the photoluminescent material may be optimized for maximum luminous performance per unit of charge. Luminance performance of the photoluminescent material may also be dependent on the magnitude of the surface illumination of the material by the excitation light source (i.e., the intensity of the light source used to charge the photoluminescent material) and the duration of time the photoluminescent material is exposed to the light source. As is known to those of skill in the art, surface illumination may be a function of the intensity of the light source and the distance between the light source and the surface of the illuminated photoluminescent material.

Accordingly, there are a large number of variations of the photoluminescent material and how it is used in the PWSI that may impact the photoluminescent performance of the PWSI. Consequently, it may be desirable to evaluate the photoluminescent material's performance in "real life" operational scenarios in order to determine the optimum composition of the photoluminescent material for the particular use to which it will be put. This evaluation may, for example be accomplished by testing using a range of light activation conditions. Table 1 below provides the surface illumination for several exemplary conditions that may be tested. Surface illumination is measured in units of lux and measurements of the surface illumination were performed using an IM-2D illumination meter.

TABLE 1

Surface Illumination Using Different Light Activation Conditions

| Light Source | Distance between light source and PWSI material | Surface Illumination (Lux) |
|---|---|---|
| Direct Sun | N/A | 25,000 |
| Shade/Cloudy | N/A | 11,500 |
| 40 W Flourescent Light | 2 feet | 1000 |
| 65 W Fluorescent Light | 9 feet | 195 |
| 65 W Fluorescent Light | 29 feet | 25 |

Table 2 below provides exemplary luminance values of an exemplary PWSI photoluminescent material measured after a light source, a 40 W Fluorescent Light with a 5-minute exposure time, was removed. Luminance measurements were conducted using an International Light IL1700 research radiometer with a SED033 visible light detector.

TABLE 2

ASTM E2073 Test Method for Photopic Luminance of Photoluminescent Markings

| Time (Minutes) | PWSI Luminance Results (mcd/m$^2$) |
|---|---|
| 1 | 2,480 |
| 10 | 441 |
| 60 | 63.7 |
| 120 | 21.4 |
| 320 | 7.8 |

As noted above, a luminance value of 0.032 mcd/m$^2$ is generally deemed the limit for human perception. At the rate of exponential decay, it is therefore evident that this exemplary photoluminescent material would be visible for over 8 hours (i.e., the typical night operational period of a weapon).

Reference will now be made in detail to the present embodiments of the invention, examples of which are illustrated in the accompanying drawings. Wherever possible, the same reference numbers will be used throughout the drawings to refer to the same or like parts.

FIG. 1 illustrates a weapon sight, in accordance with an aspect of the invention. As illustrated, weapon sight 100 comprises an eyepiece housing 104 at a rearward end of weapon sight 100, a main housing 106 at a forward end of weapon sight 100, and a mounting base 108 for mounting weapon sight 100 to, for example, a rifle. Further, as shown, in this exemplary embodiment, weapon sight 100 comprises two adjustment assemblies 110 for providing separate vertical and horizontal adjustments of weapon sight 100. Additionally, as illustrated, weapon sight 100 also comprises a light transmitting assembly 112.

Figure 2:
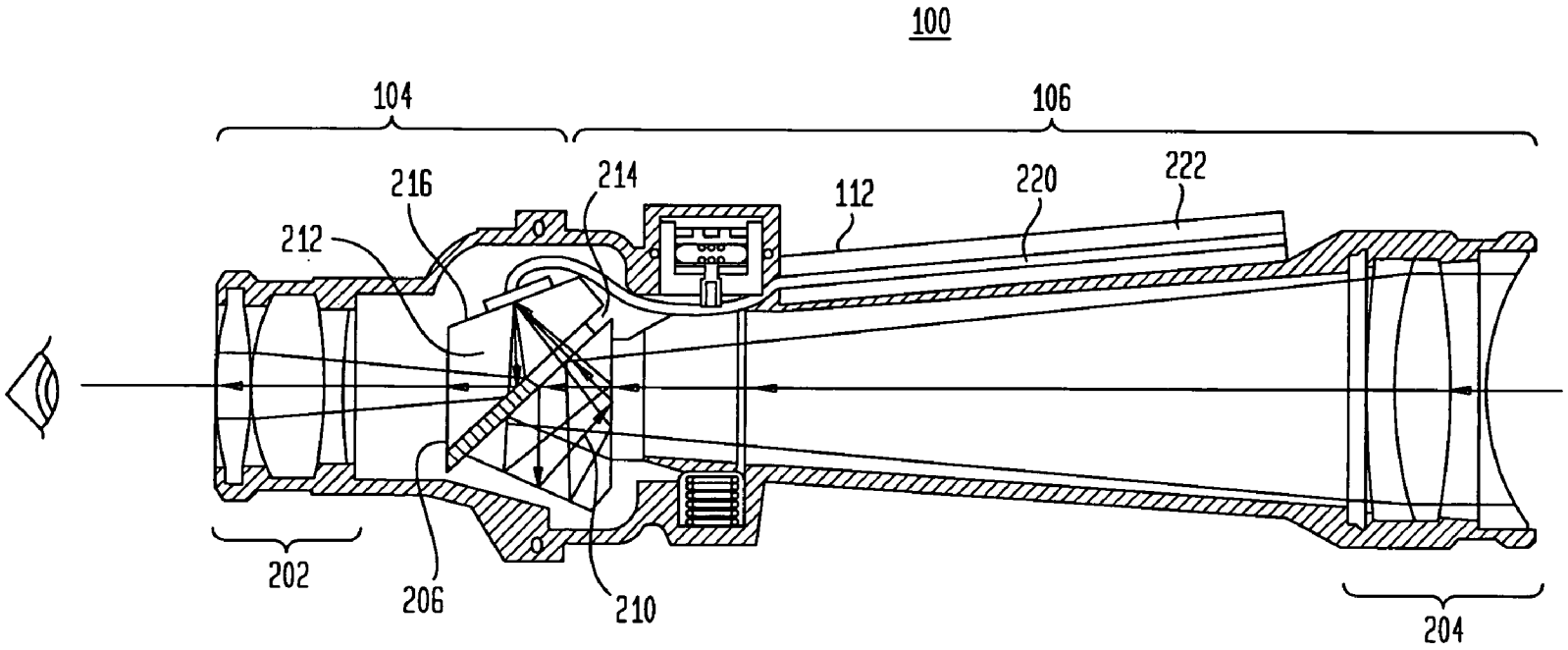
FIG. 2 illustrates a cross-sectional view of weapon sight, in accordance with an aspect of the invention.
Figure 6:
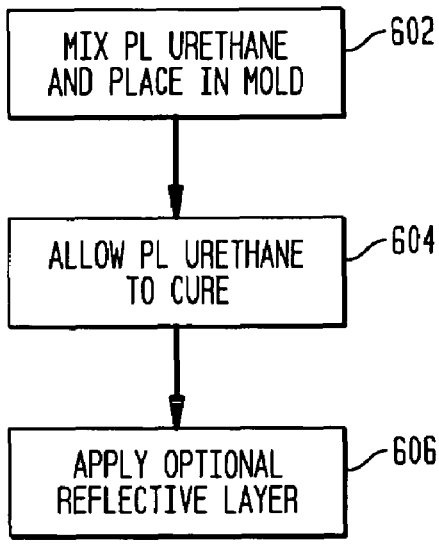
FIG. 6 illustrates a flow chart of an exemplary method for forming a photoluminescent tube comprising an inner photoluminescent layer and an optional outer reflective layer, in accordance with an aspect of the invention.

FIG. 2 illustrates a cross-sectional view of weapon sight 100, in accordance with an aspect of the invention. As illustrated, eye piece housing 104 contains a set of optical lenses 202. Likewise, main housing also comprises a set of optical lenses 204. Weapon sight 100 further comprises an image erector mechanism comprising a prism assembly 206. The prism assembly 206 may be, for example, a Pechan prism capable of inverting the image so that it is viewed in the proper orientation for the user. In this example, prism assembly 206 comprises a roof prism 210 and a helper prism 212 separated by an air gap 214. Pechan prisms, also referred to as Schmidt-Pechan prisms, are well known in the optical arts and are not described further herein. In the present invention, an upper surface of helper prism 212 is silver coated, thus providing a silver coat 216 that provides a mirror surface. Further, a reticle pattern, such as the below discussed reticle pattern of FIG. 6, is etched into the silver coat 216. A further description of exemplary optical lenses and prism assemblies is provided in U.S. Pat. No. 4,806,007 entitled "Optical Gun Sight," which is incorporated herein in its entirety.

As illustrated, light assembly 112 comprises a fiber optic 220. Further, in this example, fiber optic 220 is axially covered or surrounded by a photoluminescent translucent shield 222. As shown, fiber optic 220 is located on the outside of main housing 106. In an embodiment, fiber optic 220 is made of a translucent red material capable of collecting and transmitting light to the reticle on the silver coat 216. Thus, during daylight operations, fiber optic 220 collects light that is then transmitted through the housing 106 where it illuminates the reticle etched into silver coat 216. Thus, the reticle may be visible to the viewer during daylight operations or other operations in which there is sufficient light (e.g., from electric light sources).

Photoluminescent translucent shield 222 may comprise a photoluminescent material. Thus, during low light (e.g., during night time) operations, photoluminescent translucent shield 222 provides a light source for illuminating the reticle sketched on silver coat 216. That is, during low light operations, light from photoluminescent translucent shield 222 is axially absorbed by fiber optic 220 where it is transmitted to and illuminates the reticle thus rendering the reticle visible during these low light operations. As such, in the present example, photoluminescent translucent shield 222 is a PWSI. In addition, as shown, translucent shield 222 is external to weapon sight 100. Thus during non-low light conditions, the photoluminescent translucent shield 222 may be passively charged by the light source (e.g., the sun or an electric light source).

Translucent shield 222 may be, for example, a urethane based polymer loaded with Strontium Aluminate ("SrAl") or similar high performance phosphor crystals. The concentration of phosphor crystals in the polymer and/or the size of the phosphor crystals may be varied to achieve different results. In general, increasing the concentration of phosphor crystals, their size, or both results in increased luminance performance of the resulting shield 222. However, it also generally increases costs and can affect the non-luminance properties of the polymer. Additionally various additives may be added to the composition to achieve different results, such as to accelerate cure time, enhance durability, maximize clarity, improve pigment suspension, increase anti-sag characteristics, increase solvent resistance, and modify the flexibility of the resulting polymer. For example, in an embodiment, Europium doped $SrAl_2O_4$ may be used for providing photoluminescent characteristics to translucent shield 222. Further, in one embodiment, the urethane may be a urethane coating system comprising two parts: a base primer paint; and a translucent photoluminescent paint. The coating system may also comprise an optional clear protective topcoat sealer. Each of the three paints may be comprised of a two component, high solids, moisture cured polyurethane coating. The first component may, for example, comprise polyester resins, pigments and solvent, with the second component acting as a hardener. The second component may, for example, comprise clear aliphatic isocyanate resin and solvent. Each of the paints may for example, be applied to a thickness of 3-6 mils for a total coating system thickness of 9-18 mils.

In an embodiment, the entire translucent shield 222 comprises the photoluminescent materials. In another embodiment, only a portion (e.g., half of translucent shield 222) comprises photoluminescent materials and the other portion may be, for example, left clear. As noted above, the excitation source of photoluminescent materials may be visible and/or invisible light.

Using photoluminescent materials to provide a light source for illuminating a reticle offer several advantages. These advantages include: they can be applied easily, they do not require an external (e.g., electrical) source (i.e., they are a passive system), its not a hazardous (e.g., non-radioactive), they are reusable and sustainable technology, they are durable and relatively maintenance-free, they have high reliability (i.e. that have utility even when damaged), they are technology that is readily available, they are relatively inexpensive to use, and they may be easily and quickly used to replace existing parts on current weapon sights.

For example, in an embodiment, a current weapon sight using a Tritium lamp may be retrofitted to use photoluminescence. In such an example, the translucent shield originally included on the weapon sight may be replaced with a photoluminescent shield such as those described herein. Further, in such an example, the tritium lamp originally included in the weapon sight may be removed if desired.

Figure 3:
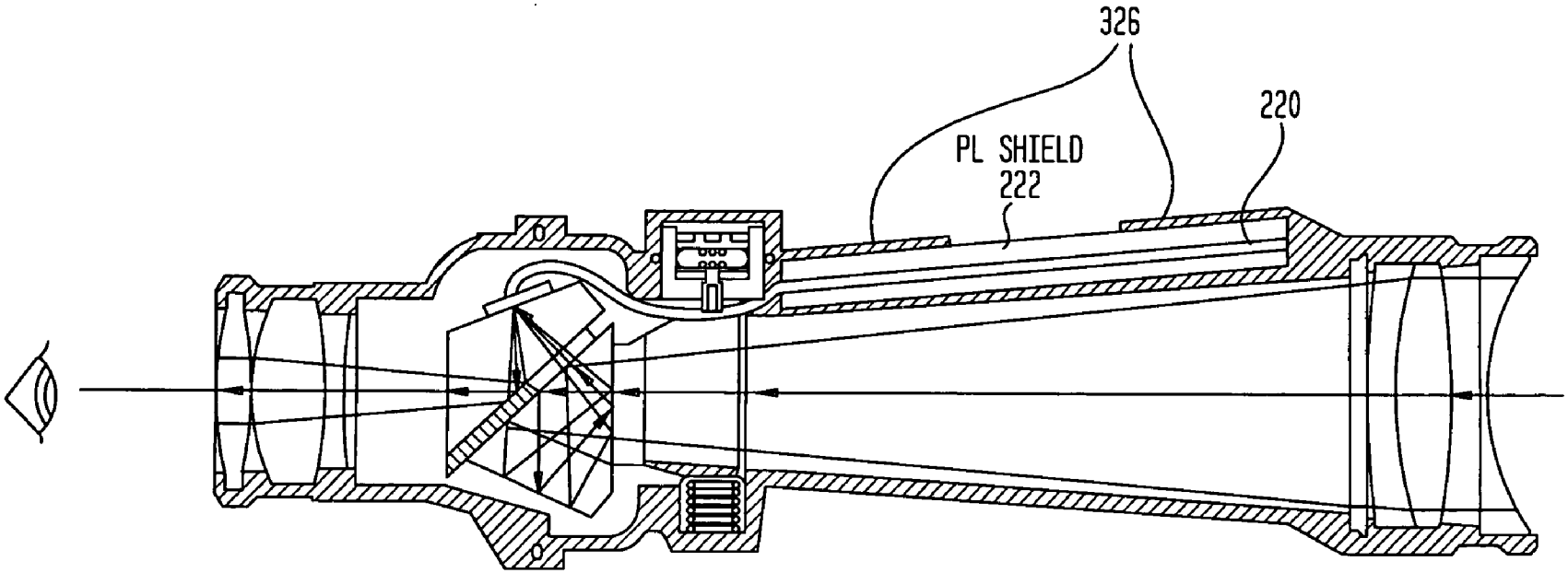
FIG. 3 illustrates a cross-sectional view of weapon sight including a shroud, in accordance with an aspect of the invention.

FIG. 3 illustrates an exemplary weapon sight that comprises an optional shroud, in accordance with an aspect of the invention. FIG. 3 is identical to FIG. 2 with the exception of optional shroud 326. Shroud 326 may be used to cover photoluminescent shield 222 during low light operations, so that the photoluminescent translucent shield 222 is not visible to, for example, enemy combatants. This shroud may be a mechanical or automatic device for covering translucent shield 222 during low light conditions. Then, during lighted conditions (e.g., daytime), the shroud may be removed (e.g., slid off) so that sunlight (or, e.g., electrically generated light) may reach light assembly 112 to both illuminate the reticle and charge the photoluminescent translucent shield 222. Shroud 326 can also be used to regulate the light during daytime operations.

In another embodiment, a photoluminescent tube, internal to weapon sight 100 and encapsulating at least a portion of fiber optic 220, may be used as a light source for illuminating the reticle during low light operations. In this embodiment, translucent shield 222 need not be photoluminescent, but instead may simply be comprised of a translucent material such as a clear urethane polymer.

Figure 4:
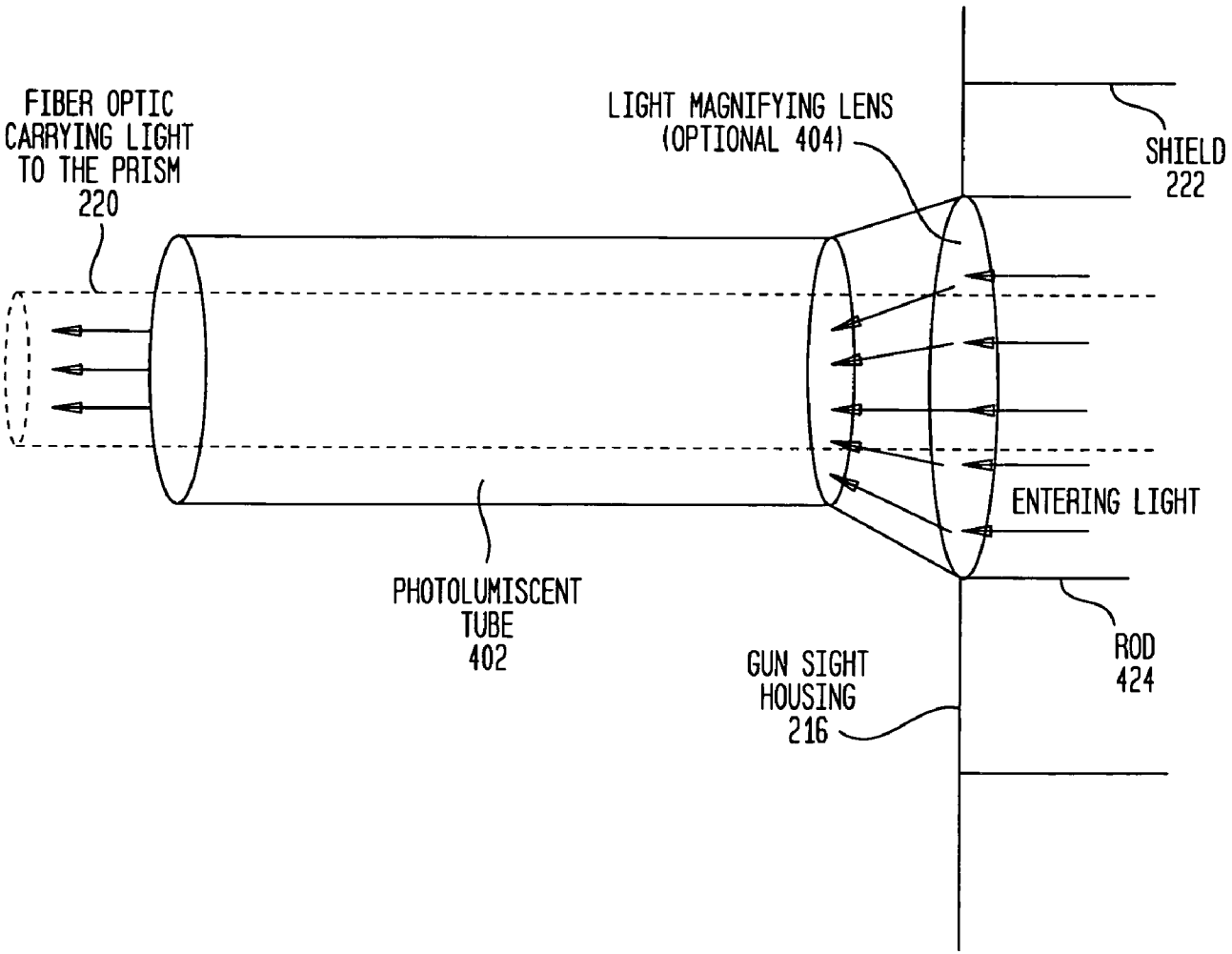
FIG. 4 illustrates a close-up view of a fiber optic encapsulated by a photoluminescent tube, in accordance with an aspect of the invention.

FIG. 4 illustrates a close-up view of a fiber optic axially encapsulated or surrounded by a photoluminescent tube, in accordance with an aspect of the invention. The weapon sight of the embodiment of FIG. 4 may be identical to the above-discussed embodiment of FIG. 2 with the exception that this example uses a photoluminescent tube 402 and a rod 424 that connects an internal portion of fiber optic 220 with an external portion of fiber optic 220. Further, in this example, shield 222 need not be photoluminescent shield, but instead may simply be a translucent shield.

As illustrated, fiber optic 220 is connected to rod 424, such that rod 424 is external to main housing 216. Rod 424 may serve to connect an internal portion of fiber optic 220 that is internal to main housing 216 and an external portion of fiber optic 220 that is external to main housing 216. As illustrated, internal to main housing 216, a portion of fiber optic 220 is encapsulated by a photoluminescent tube 402. As discussed above, during daylight (or other lighted conditions) light provided by fiber optic 220 illuminates silver coat 216. In the present embodiment, this light also charges photoluminescent tube 402. Thus, during low light conditions (e.g., nighttime), light is emitted from photoluminescent tube 402 that is axially absorbed by fiber optic 220. Fiber optic 220 then illuminates the reticle of silver coat 216 using this photoluminescent light such that the reticle is visible during these low light conditions.

Further, as illustrated, weapon sight 100 comprises an optional lens 404 incorporated at one end of the rod 424. External light transmitted through the external portion of fiber optic 220 is amplified by the optical lens to help charge the photoluminescent tube 404. The light is further transmitted by the fiber optic 220 to the reticle of silver coat 216. As such, in the present example, photoluminescent tube 402 is a PWSI. Because in this example photoluminescent tube 402 is internal to main housing 106, the photoluminescent light generated by photoluminescent tube 402 will not significantly be externally visible. Therefore, a shroud, such as that discussed above with reference to FIG. 3, may not be necessary to hide the photoluminescent light.

Figure 5:
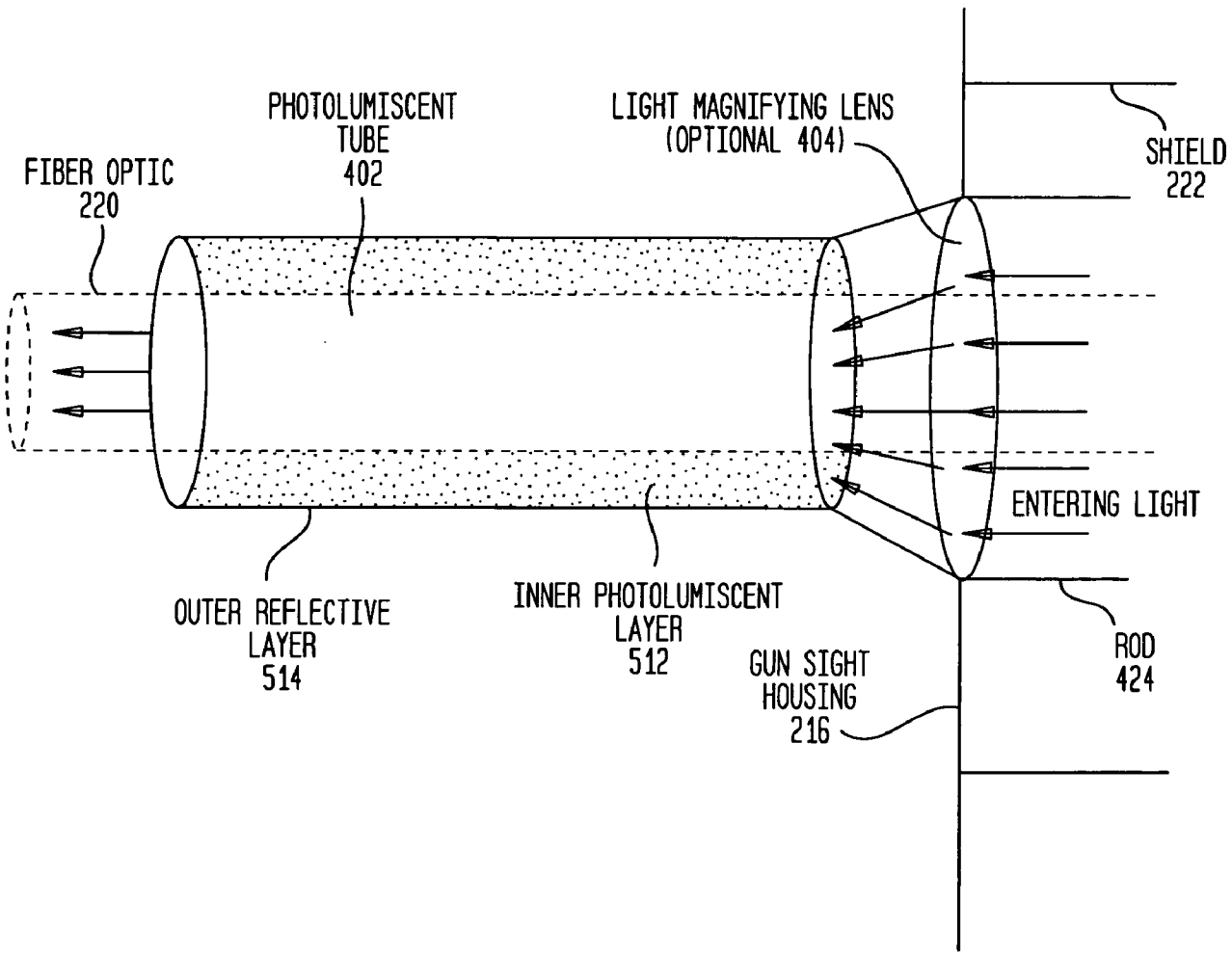
FIG. 5 illustrates a cross-section view of the photoluminescent tube of FIG. 4, in accordance with an aspect of the invention.

FIG. 5 illustrates a cross-section view of the photoluminescent tube of FIG. 4. As illustrated, in this example photoluminescent tube 402 comprises an inner photoluminescent layer 512 and an outer reflective layer 514. The inner photoluminescent layer 512 may be, for example, a urethane based polymer loaded with Strontium Aluminate ("SrAl") or similar high performance phosphor crystals. The concentration of phosphor crystals in the polymer and/or the size of the phosphor crystals may be varied to achieve different results. In general, increasing the concentration of phosphor crystals, their size, or both results in increased luminance performance of photoluminescent layer 512. However, it also generally increases costs and can affect the non-luminance properties of the polymer. Additionally various additives may be added to the composition to achieve different results, such as to accelerate cure time, enhance durability, maximize clarity, improve pigment suspension, increase anti-sag characteristics, increase solvent resistance, and modify the flexibility of the resulting polymer. For example, in an embodiment, inner photoluminescent layer 512 may be a two-part polyester urethane loaded with Europium doped $SrAl_2O_4$ phosphor crystals. Outer reflective layer 514 is preferably a reflective coating, such as for example, a metal reflective foil or a white paint. Although the present embodiment uses an outer reflective layer, in other embodiments this outer reflective layer is optional and need not be used.

Further, in one embodiment, the photoluminescent tube 402 may be a two-part urethane coating system. The urethane coating system may be composed of two parts: a white reflective base coat base primer paint and an opaque a photoluminescent paint. Each of the three paints may be comprised of a two component, high solids, moisture cured polyurethane coating. Component A may comprise polyester resins, pigments and solvent. Component B, may act as the hardener and comprise a clear aliphaticisocynate resin and solvent. Each of the paints may be applied to a thickness of 3-6 mils for a total coating system thickness of 6-12 mils.

In one embodiment, photoluminescent tube 402 may be formed by a casting technique. FIG. 6 illustrates a flow chart of an exemplary method for forming a photoluminescent tube comprising an inner photoluminescent layer and an optional outer reflective layer, in accordance with an aspect of the invention. In this example, photoluminescent layer 512 is formed by a two-part urethane based polymer loaded with SrAl phosphor crystals. First, the two-part urethane is mixed and placed in a mold (S602). This mold is preferably cylindrical. Further, the mold preferably comprises a cavity large enough for the fiber optic to be fit thru. Next, the urethane is allowed to cure to form photoluminescent layer 512 (S604). Then, the reflective layer 514 is applied (S606). This reflective layer 514 may be applied, for example, by a painting (e.g., a spray paint technique) or by wrapping a reflective metal foil around photoluminescent layer. After forming photoluminescent tube, the tube may then be fitted over the fiber optic by, for example, sliding the fiber optic through the cavity of the photoluminescent tube.

In another, the photoluminescent tube may be initially formed as a cylinder and then a hole drilled lengthwise through the tube to form the cavity for the fiber optic. Although in this example, photoluminescent tube is formed by a casting technique, other mechanisms may be used for forming a photoluminescent tube, without departing from the invention. Likewise, the photoluminescent shield discussed above may be formed in a similar manner, such as by, for example, using a casting technique.

Further, as noted above, the present invention may be used to retrofit current weapon sights. For example, a photoluminescent tube, such as that discussed above, may be slid over the fiber optic of a weapon sight currently using a Tritium lamp to illuminate the reticle. In such an example, the Tritium lamp, either before or after the photoluminescent tube is installed, may be removed from the weapon sight and appropriately discarded.

Figure 7:
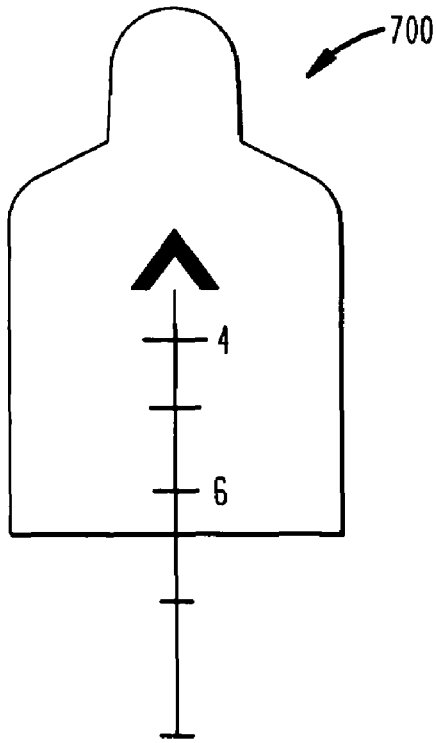
FIG. 7 illustrates an exemplary reticle pattern, in accordance with an aspect of the invention.

FIG. 7 illustrates an exemplary reticle pattern 700, in accordance with an aspect of the invention. As noted above, this exemplary reticle patterns may be etched into silver coat 216. Further, it should be noted that this figure illustrates but one exemplary reticle pattern and other reticle patterns may be used without departing from the scope of the invention.

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart there-from.

What is claimed is:

1. An article of manufacture in combination with a weapon sight having a reticle pattern and fiber optic, the article of manufacture comprising:

a photoluminescent tube comprising a passively charged photoluminescent material, each of the photoluminescent tube and the photoluminescent material axially surrounding at least a portion of a fiber optic of the weapon sight;

wherein at least a portion of the fiber optic is external to the weapon sight;

wherein the photoluminescent tube is at least partially internal to the weapon sight;

wherein the photoluminescent tube is configured so that, when installed in the weapon sight, the photoluminescent material, when passively charged by a light source, provides light which is axially introduced into the fiber optic along a length of the fiber optic that extends in a longitudinal direction of the weapon sight and transmitted during low light conditions to illuminate the reticle pattern.

2. The article of manufacture of claim 1, wherein the photoluminescent material comprises strontium aluminate phosphor crystals.

3. The article of manufacture of claim 2, wherein the strontium aluminate phosphor crystals comprise $SrAl_2O_4$.

4. The article of manufacture of claim 3, wherein the tube comprises:

a first layer comprising the photoluminescent material; and a second layer comprising a reflective coating; and wherein the tube comprises a cavity dimensioned to permit the fiber optic to pass through the tube.

5. The article of manufacture of claim 4, wherein the first layer further comprises a urethane.

6. The article of manufacture of claim 5, wherein the urethane is a two-part urethane.

7. A weapon sight comprising:

a first set of one or more optical lenses located at a forward end of the weapon sight for receiving light from a target to be sighted;

a second set of one or more optical lenses located at a rearward end of the weapon sight for viewing an image of the target;

an image erector mechanism between the first and second set of one or more optical lenses for providing a properly oriented image of the target through the second set of one or more optical lenses;

a reticle projecting mechanism for providing a reticle pattern with the image of the target from the second set of one or more optical lenses;

a fiber optic at least partially external to the weapon sight and configured to collect and transmit light to the reticle projecting mechanism so as to illuminate the reticle pattern; and a photoluminescent tube at least partially internal to the weapon sight, axially surrounding at least a portion of the fiber optic, wherein the photoluminescent tube comprises a passively charged photoluminescent material which axially surrounds at least a portion of the fiber optic;

wherein the photoluminescent material is configured so that, when passively charged by a light source, the photoluminescent material provides light which is axially introduced into the fiber optic along a length of the fiber optic that extends in a longitudinal direction of the weapon sight and transmitted during low light conditions to illuminate the reticle pattern.

8. The weapon sight of claim 7, wherein the photoluminescent material comprises strontium aluminate phosphor crystals.

9. The weapon sight of claim 7, wherein the photoluminescent tube comprises:

a first wall layer comprising the photoluminescent material;

a second wall layer comprising a reflective coating; and wherein the photoluminescent tube comprises a cavity dimensioned to permit the fiber optic to pass through the tube.

10. The weapon sight of claim 7, wherein the fiber optic comprises:

a first fiber optic portion at least partially external to the weapon sight and configured to absorb and transmit light;

a second fiber optic portion configured to receive and transmit light to the reticle projecting mechanism to illuminate the reticle pattern; and a rod configured to connect the first fiber optic portion with the second fiber optic portion.

11. The weapon sight of claim 10, wherein the fiber optic further comprises:

a third set of one or more lenses configured to focus light from the rod into the second fiber optic portion.

12. The weapon sight of claim 7, further comprising: a photoluminescent shield configured to cover at least a portion of the fiber optic.

13. The weapon sight of claim 7, further comprising:

a shroud which is configured to cover at least a portion of the photoluminescent material.

* * * * *